US010177508B2

(12) United States Patent
Boone

(10) Patent No.: US 10,177,508 B2
(45) Date of Patent: Jan. 8, 2019

(54) INTEGRATED WIRE MANAGEMENT DEVICE FOR AUDIO HEADPHONES

(71) Applicant: Thomas Boone, San Carlos, CA (US)

(72) Inventor: Thomas Boone, San Carlos, CA (US)

(73) Assignee: Thomas D. Boone, San Carlos, CA (US)

( * ) Notice: Subject to any disclaimer, the term of this patent is extended or adjusted under 35 U.S.C. 154(b) by 0 days.

(21) Appl. No.: 15/721,924

(22) Filed: Oct. 1, 2017

(65) Prior Publication Data

US 2018/0109049 A1 Apr. 19, 2018

Related U.S. Application Data

(60) Provisional application No. 62/409,381, filed on Oct. 18, 2016, provisional application No. 62/501,745, filed on May 5, 2017.

(51) Int. Cl.

| | |
|---|---|
| ***H01R 13/72*** | (2006.01) |
| ***B65H 75/44*** | (2006.01) |
| ***B65H 75/28*** | (2006.01) |
| ***H04R 1/10*** | (2006.01) |
| *H04R 5/033* | (2006.01) |

(52) U.S. Cl.

CPC ..... *H01R 13/72* (2013.01); *B65H 75/285* (2013.01); *B65H 75/446* (2013.01); *B65H 75/4476* (2013.01); *H04R 1/1033* (2013.01); *B65H 2701/3919* (2013.01); *B65H 2701/536* (2013.01); *H04R 5/033* (2013.01)

(58) Field of Classification Search

CPC ..... H01R 13/72; H04R 1/105; H04R 1/1033; H04R 5/033; B65H 75/4476; B65H 75/285; B65H 75/446; B65H 2701/536

USPC ..... 439/501

See application file for complete search history.

(56) References Cited

U.S. PATENT DOCUMENTS

| | | | | |
|---|---|---|---|---|
| 5,329,592 | A * | 7/1994 | Altman | A41D 20/00 2/171 |
| 8,009,847 | B2 * | 8/2011 | Planansky | H04R 5/02 2/422 |
| 9,049,508 | B2 * | 6/2015 | Puskarich | H04R 5/033 |
| 9,216,114 | B2 * | 12/2015 | Voix | A61F 11/12 |
| 9,578,409 | B1 * | 2/2017 | Crockran, Jr. | H04R 1/105 |
| 9,602,910 | B2 * | 3/2017 | Kim | H04R 3/00 |
| 9,619,201 | B2 * | 4/2017 | Jannard | G02C 9/04 |

* cited by examiner

*Primary Examiner* — Jean F Duverne

(57) ABSTRACT

A wire management device for storing an earphone wire having a signal terminal and a pair of speakers includes an elongated frame having first and second ends, the frame having a first channel to hold a first wrapped part of the wire, first and second beaks respectively arranged at the first and second ends of the frame to stay the terminal of the wire, and first and second wings respectively branching from neighboring positions of the first and second ends the frame, the first and second wings are, respectively, bent toward the first and second ends of the frame for wrapping the wire, wherein at least one of the wings includes a clamping portion to clamp a last wrapped part of the wire.

20 Claims, 5 Drawing Sheets

INTEGRATED WIRE MANAGEMENT DEVICE FOR AUDIO HEADPHONES

RELATED APPLICATIONS

This application claims the priority of U.S. Provisional Application No. 62/409,381, filed on Oct. 31, 2016, and No. 62/501,745, filed on May 5, 2017, which are hereby incorporated in its entirety by reference.

BACKGROUND OF THE INVENTION

Field of the Invention

The present invention relates generally to a wire management device, more specifically, an integrated wire management device for retaining flexible wire systems containing jack plugs.

Background of the Invention

The current state of the headphone wire management includes both flexible systems (e.g., fabric-based) that remain attached to the headphone wires, and inflexible units (e.g., plastic) that separate from the headphone wires when unwound.

When earphones are stored in a pocket or a purse the wires can become so tangled that the user can waste many tens of seconds to minutes untangling them before each use. Beyond simple inconvenience, this inefficient untangling process can result in missed or dropped phone calls, property damage from fumbling with knotted wires, and general frustration causing users to avoid using earphones altogether. Prior inventions have focused on independent units using slots or holes to secure various components of the earphone while the cable is wrapped tightly around the body of the device. These devices typically do not keep earphone wires from tangling, but do not have a particularly fast deployment function and must be unwrapped much the same way they are wrapped. Additionally, the earphones in most cases must be separated from the storage device before each use, requiring the user to keep up with yet another item. Accordingly, there is a need to solve the problem of earphone cable tangling during storage with a device that facilitates in the rapid deployment of earphone when desired and is fully integrated into the earphone system.

SUMMARY OF THE INVENTION

This invention takes into consideration the issues above. One of the objects of this invention may be to provide a wire management device that seamlessly integrates an earphone system into the wire management device. Rapid deployment can be accomplished by simply allowing gravity to unwind the wire from the device during placement of the earphones into the user's ears. Once installed, the device can securely hold part of an audio jack end of the earphone cable. The audio jack end may be referred to as a signal terminal, and the earphone cable may be referred to as an earphone wire. For storage the wire is simply wrapped snuggly around a pair of wings of the device, and the final length of the wire near the ear pieces is secured in a clamp portion formed with the wing.

According to embodiments of the present invention, the device includes a central channel in which the part of the wire is embedded to create the integrated system. The channel is designed with a diameter to press firmly against the sides of most popular earphone cable so as to secure the cable into the device and preclude it from separating the earphones from the device. This pressure fitting along with the beak structure is for keeping the earphone cable connected to the cable management device.

BRIEF DESCRIPTION OF THE DRAWINGS

The presently disclosed embodiments will be further explained with reference to the attached drawings. The drawings shown are not necessarily to scale, with emphasis instead generally being placed upon illustrating the principles of the presently disclosed embodiments.

Figure 1A:
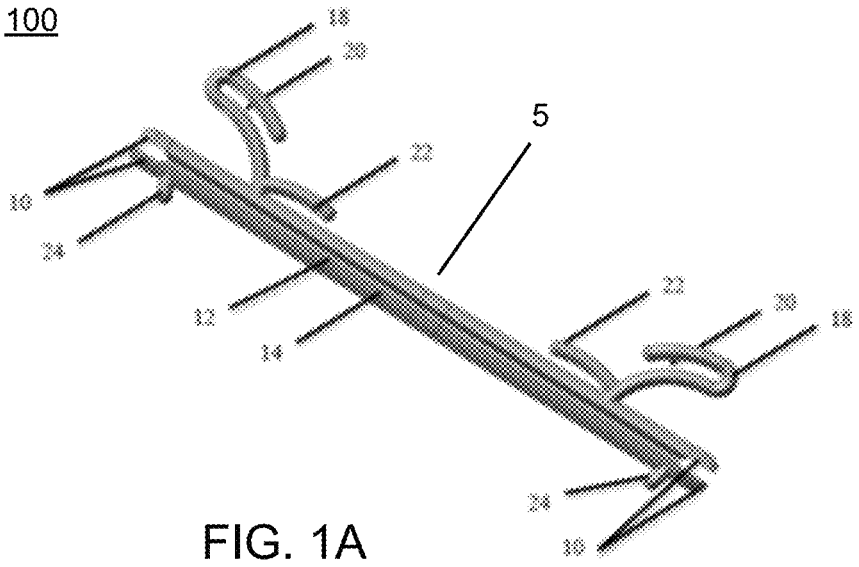
FIG. 1A is a front side perspective of an integrated wire management system according to embodiments of the present invention.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION OF THE PREFERRED EMBODIMENTS

Various embodiments of the present invention are described hereafter with reference to the figures. It would be noted that the figures are not drawn to scale and elements of similar structures or functions are represented by like reference numerals throughout the figures. It should be also noted that the figures are only intended to facilitate the description of specific embodiments of the invention. They are not intended as an exhaustive description of the invention or as a limitation on the scope of the invention. In addition, an aspect described in conjunction with a particular embodiment of the present invention is not necessarily limited to that embodiment and can be practiced in any other embodiments of the present invention.

FIG. 1A is a front side perspective of a wire management device 100 according to embodiments of the present invention.

The wire management device 100 includes an elongated frame 5 having a first channel 12 and a second channel 14. The second channel 14 is formed at a bottom of the first channel 12. The second channel 14 is narrower than the first channel 12. The elongated frame 5 includes a beak structure 10 that are arranged at ends of the elongated frame 5. The beak structure 10 may be referred to a beak 10. Each of the beak 10 can hold a terminal of an earphone wire 30 (e.g. FIG. 2D and FIG. 3A). Further, the device 100 includes a pair of wings 18 branched from the frame 5. Each of the wings 18 is bent toward its neighboring beak 10 so that the earphone wire is wrapped between the wings 18. Further, each wing 18 includes a hook 20 formed by bending a part of the wing 18 toward another wing 18. The hook 20 of the wing 18 is configured to clamp a part of the earphone wire 31 near a set of speakers 35.

Figure 1B:
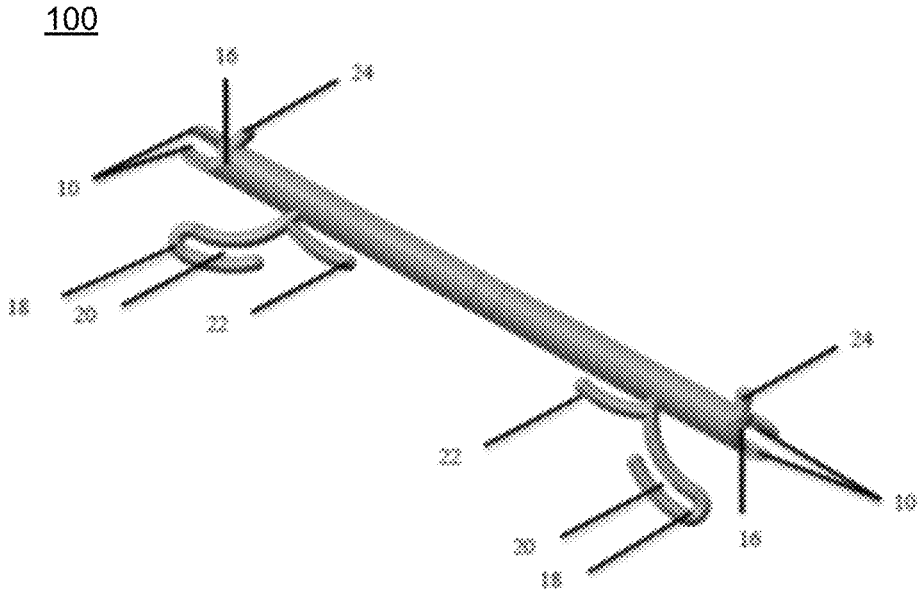
FIG. 1B is a back side view of the integrated wire management system according to embodiments of the present invention.

FIG. 1B is a back side view of the wire management device 100 according to embodiments of the present invention. The first channel 12 and the second channel 14 are not seen from the back side. A recessed section 16 is formed at part of the beak 10. An angled protrusion 24 is arranged at the base of the beak 10. The angled protrusions 24 may be referred to angled crests 24. Each of the wings 18 includes a second hook 22 branching from around the root of the wing 18 and extended toward a center of the frame 5.

Figure 2A:
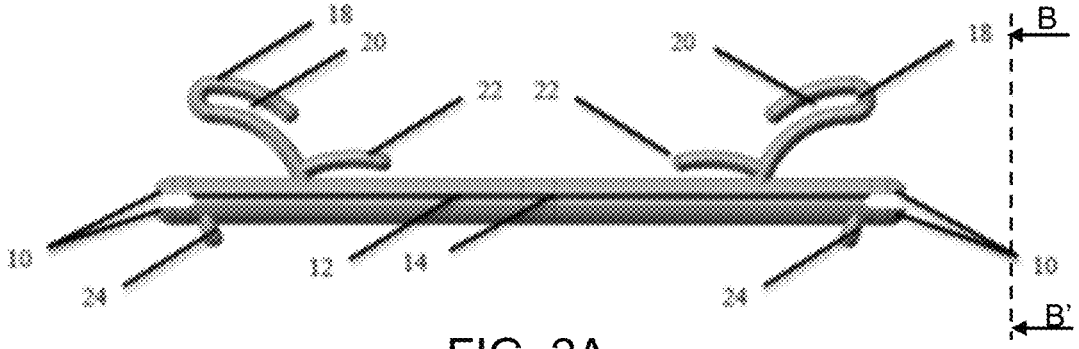
FIG. 2A is a front, horizontal view of the integrated wire management system according to embodiments of the present invention.

FIG. 2A is a front view of the wire management device 100. The channel 12 is extended to the opening of the beak 10. Each angled crest 24 is slightly tilted toward the center of the frame 5, being opposite direction to the neighboring beak 10.

Figure 2B:
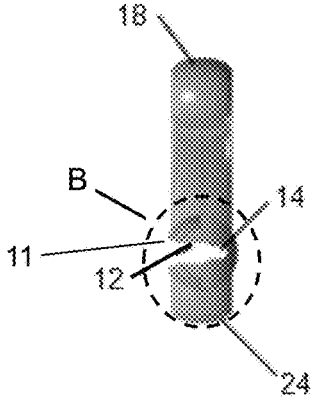
FIG. 2B is a right end head-on view B-B' of FIG. 2A of the integrated wire management system according to embodiments of the present invention.

FIG. 2B is a drawing illustrating a side view from B-B' in FIG. 2A. The view from the beak 10 illustrates that the first channel 12 and the second channel 14 are seen, in which the second channel 14 is narrower than the first channel 12. Further, chamfering sections 11 are arranged at the opening side of the first channel 12 so that the wire is smoothly slid toward the second channel 14.

Figure 2C:
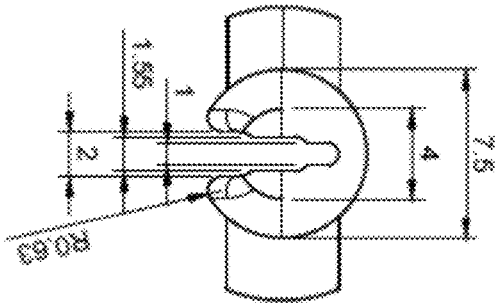
FIG. 2C is a back horizontal view of the integrated wire management system according to embodiments of the present invention.

FIG. 2C is a zoomed view of a part B in FIG. 2B. Dimensions are exemplary indicated as approximate ranges of the chamfering sections 11, the first channel 12 and the second channel 14. The chamfering sections 11 are slightly wider than the first channel 12 so as to smoothly slide part of the wire of an earphone. For instance, the width of the chamfering sections 11 may be between 1.8 and 2.2 mm, the width of the first channel 12 may be between 1.45 mm and 1.65 mm, and the width of the second channel 14 may be between 0.8 mm and 1.2 mm. Further, the elongated frame 5 may have a rounded shape cross section, but the shape is not limited to the rounded shape. For instance, the cross section of the frame 5 may be an oval shape, a triangle shape, a squared shape, rectangular shape or other polygonal shape. Further, FIG. 2A through FIG. 2D illustrate the beak 10 from different angles of view. As seen in FIG. 2A, the beak 10 is formed so that the first channel 12 is extended from the ends of the channel 12. Further, the beak 10 includes a pair of protrusions for holding (covering) approximately a half round of the terminal 30 of the wire 31.

Figure 2D:
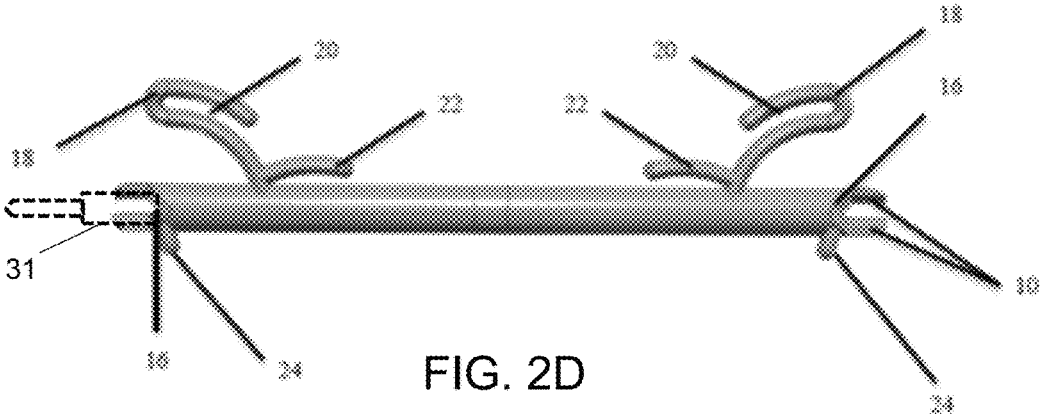
FIG. 2D is a backside view of the wire management device 100, according to embodiments of the present invention. At the right side of the beak 10, a signal terminal 31 of an earphone wire 30 is indicated by a dashed line.

FIG. 2D is a backside view of the wire management device 100, according to embodiments of the present invention. At the right side of the beak 10, a signal terminal 31 of an earphone wire 30 is indicated by dashed line.

Figure 3A:
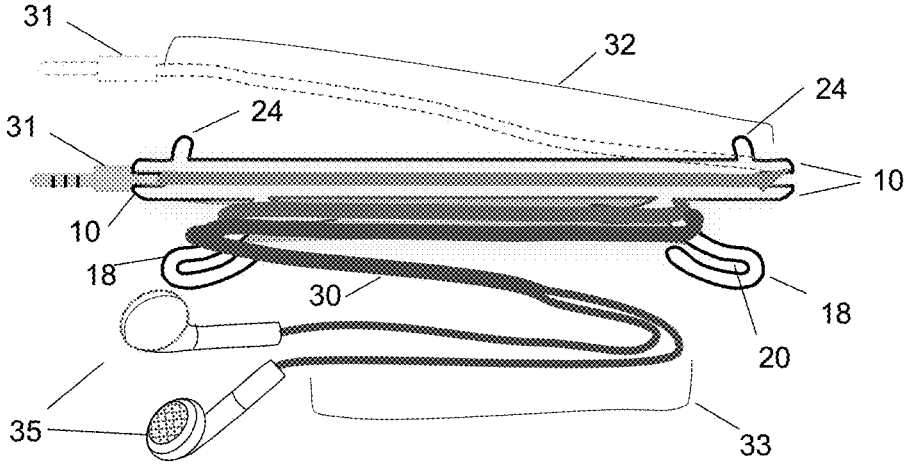
FIG. 3A is a drawing illustrating that an earphone wire is wound over a wire management device, according to embodiments of the present invention.

FIG. 3A is a drawing illustrating that an earphone wire 30 with a signal terminal 31 and a pair of speakers 35 is wrapped over the wings 18 of the wire management device 100, according to embodiments of the present invention. For instance, the signal terminal 31 may contact the inside of the protrusions of the beak 10 on the left of the device 100. In this case, a first wrapped part 32 of the earphone wire 30 is a part of the wire 30 which is connected to the signal terminal 31 and stably accommodated using the second channel 14 in the channel 12, and the wire 30 is turned at the beak 10 on the right side of the device 100 for the first turn of the wire 30. A state where the signal terminal 31 is separated from the inner side of the curved protrusions of the beak 10 is indicated by dashed lines in the figure. The rest of the wire 30 is continuously wrapped on the pair of the wings 18 until a last wrapped part 33 of the earphone wire 30 is left as indicated in the figure. For instance, a distance between the recesses of the beaks 10 may be approximately between 5 mm and 10 mm. Further, a distance between the wings 18 may be between 75 mm and 100 mm.

Figure 3B:
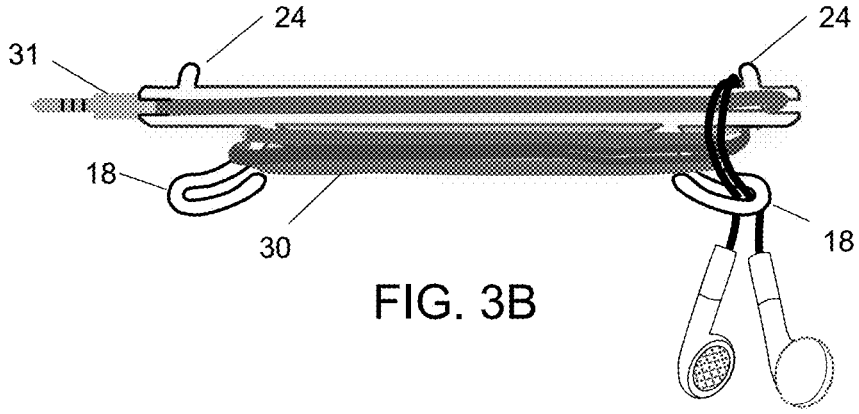
FIG. 3B is a drawing illustrating that an end part of the earphone wire is held with a hook of the wire management device, according to embodiments of the present invention.

The last wrapped part 33 corresponds to an approximate length of the wire 30 to be wrapped with one of the crest 24 and hold the wing 18 as illustrated in FIG. 3B.

FIG. 3B is a drawing illustrating that an end part of the earphone wire 30 is held with one of hooks 20 formed with the wings 18 of the wire management device 100, according to embodiments of the present invention. It is indicated that when the wire 30 approximately reaches the last wrapped part 33, the rest of the wire 30 is wrapped on the elongated frame 5 in approximately vertical to the first channel 12 using one of the angled crests 24, and the end portion of the wire 30 is clamped using the hook 20 of the wing 18 as seen in the figure.

Figure 3C:
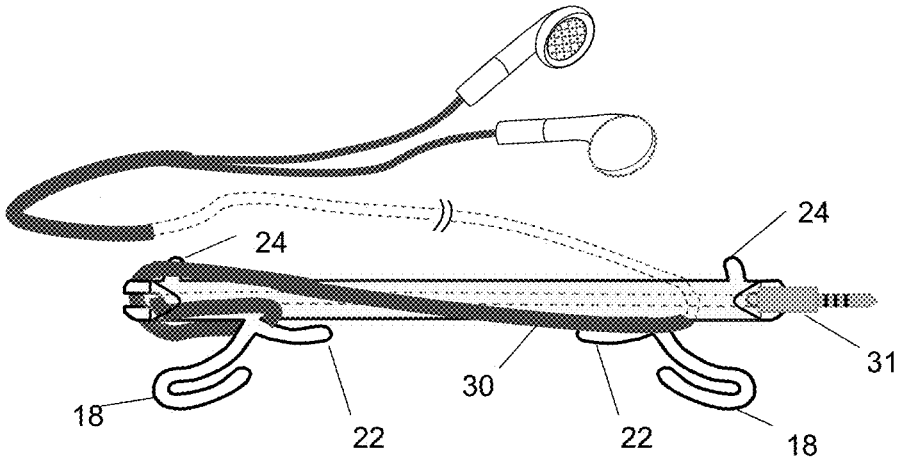
FIG. 3C is a drawing illustrating that subtle wire adjustment is performed with an additional protrusion and an angled crest of the wire management device, according to embodiments of the present invention.

FIG. 3C is a drawing illustrating that subtle wire adjustment is performed with one of second hooks 22 and an angled crest 24 of the wire management device, according to embodiments of the present invention. The second hooks 22 and the angled crests 24 are arranged to provide for adjusting a wrapping length of the wire 30, so that an appropriate length of the last wrapped part 33 of the wire 30 is left to complete the wrapping of the wire 30.

According to another embodiment of the present invention, a wire management device may include a fin 25 between the crests 24 along a side of the elongated frame 5.

Figure 4A:
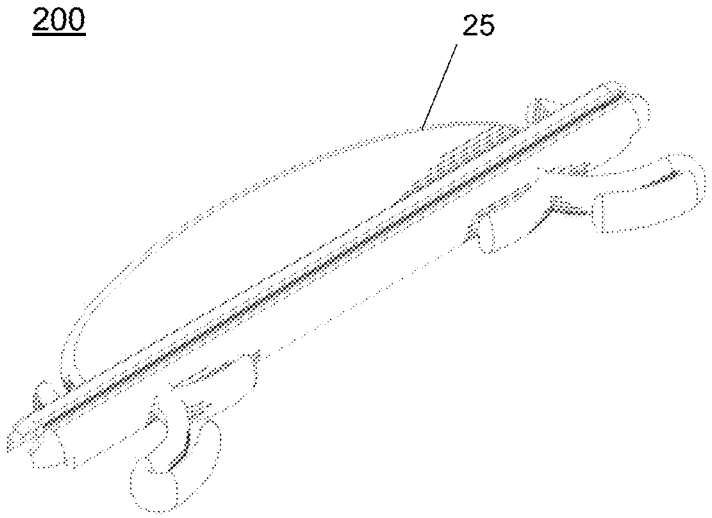
FIG. 4A is a drawing illustrating a perspective view of a fin type wire management device, according to embodiments of the present invention.

FIG. 4A is a drawing illustrating a perspective view of a fin type wire management device 200, according to embodiments of the present invention. Except for having the fin 25, other parts of the wire management device 200 are identical to those of the wire management device 100 and indicated by the same numbers used in the wire management device 100. Further, it should be noted that a plane formed by the fin 25 is approximately parallel to a plane formed by the wings 18 so as to make a process to accommodate the first wrapped part 32 of the wire 30 into the second channel 14 stable and easier.

Figure 4B:
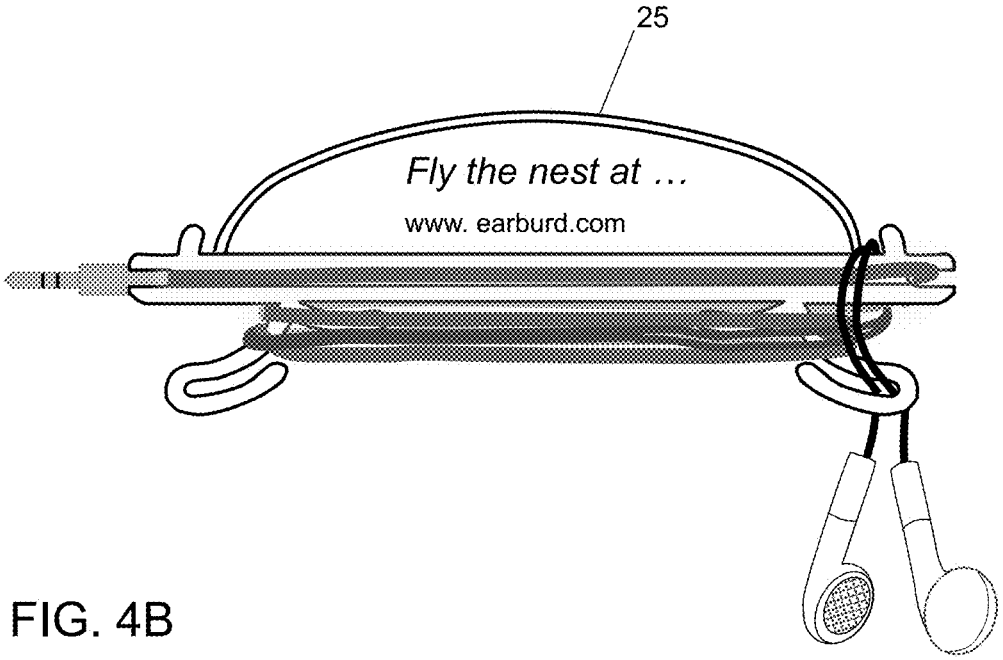
FIG. 4B is a drawing illustrating that an earphone wire is wound with a fin type wire management device, according to embodiments of the present invention.

FIG. 4B is a drawing illustrating that an earphone wire is wrapped with the fin type wire management device 200, according to embodiments of the present invention. As indicated in the figure, a flat plate of the fin 25 provides an area to write words or draw characters for advertising information from a provider of the wire management device 200. In this case, an advertising phrase, "Fly the nest at . . . " and its relevant internet address "www.earburd.com" are indicated as an example. The fin 25 of the wire management device 200 can provide a sufficient amount of marketing effects for the provider.

Figure 5A:
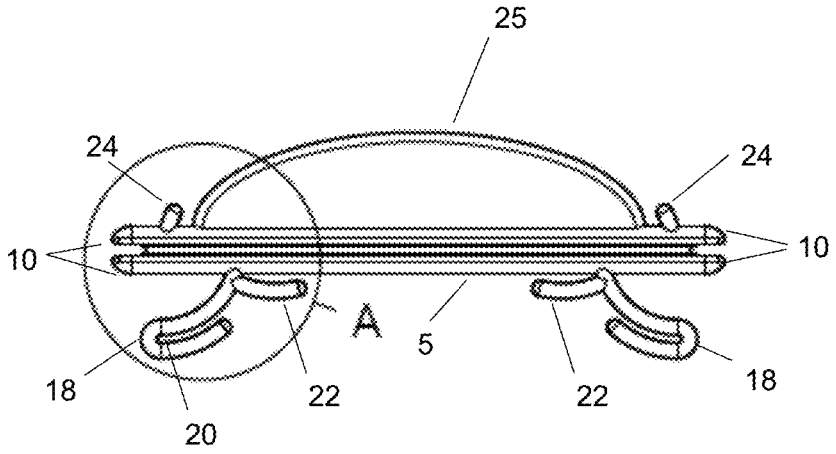
FIG. 5A is a drawing illustrating a plane view of a fin type wire management device, according to embodiments of the present invention.

FIG. 5A is a drawing illustrating a plane view of the fin type wire management device 200 without an earphone wire, according to embodiments of the present invention. A left part of the device 200 is indicated by magnifying a circled area A.

Figure 5B:
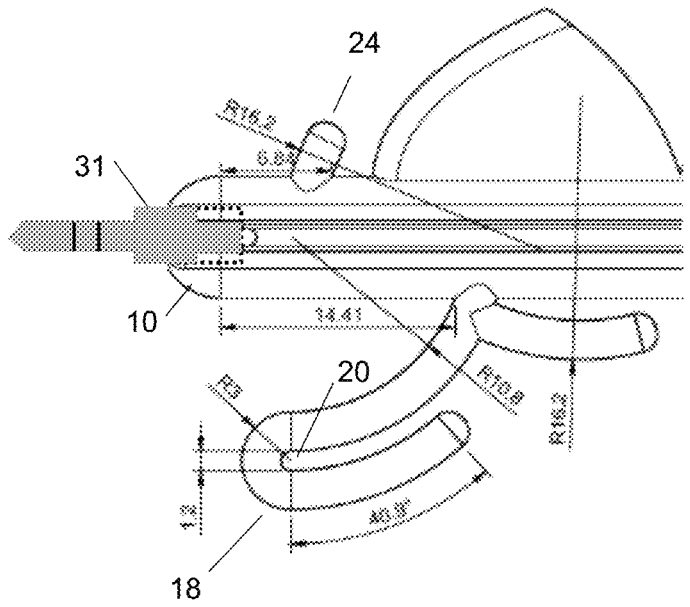
FIG. 5B is a drawing illustrating a zoomed view of the fin type wire management device holding a part of a signal terminal with a beak, according to embodiments of the present invention.

FIG. 5B is a drawing illustrating a zoomed view of the fin type wire management device 200 holding the signal terminal 31 with a left side beak 10, according to an embodiment of the present invention. A part of the signal terminal 31 is arranged the backside of the first channel 12 as indicated by dashed lines. The area indicated by the dashed lines corresponds to an end part of the signal terminal 31. After being held by the end part of the signal terminal 31, the first wrapped part 32 of the wire 30 is accommodated into the second channel 14 through the first channel 12 so that the signal terminal 31 and the first wrapped part 32 of the wire 30 can be securely fixed with the management device 200. This process is similarly performed with the management device 100. As an example, the dimensions of the first and second hooks 18 and 22 and the crest 24 formed on the elongated frame 5 of the management device 200, where the numbers are indicated in a unit of millimeter. For instance, the values of the dimensions indicated in the figure may be modified by ±5% according to the requirement of the product.

Central to the design are two wings 18 perpendicular to the body of the unit used for wrapping the headphone wire 30 and securing the first wrapped part 32. These wings 18 are spaced in such a way that when the cable is wrapped firmly around them the microphone portion of many popular earphones will be positioned in between the hooks.

The inclusion of small second hooks 22 for subtle wire adjustment and to secure the wrapped wires 30 during storage. The wire adjustment function enables the accommodation of many different earphone brands and types. These second hooks 22 act as restraints for and additional wraps at the beginning so that the users microphone will land between the hooks during normal wrapping. Once the cable is locked into the second hooks 22 it can stay in this configuration indefinitely, allowing the user to maintain the custom length for more efficient usage of the wrapping device.

Two additional features of the device are critical for restraining the earpieces during storage once the cable has been wrapped. The first feature is a pair of small protrusions called crest 24 on the opposite side of the device body from the hooks. The second feature is a pair of hooks 20 formed by folding the wings 18 backward onto themselves. Once the cable is almost completely wrapped around the wings the final length of cable 33 is wrapped once around the body below the crest 24 then slid into the hooks 20. The hooks 20 are designed with a width and a material flexibility just wide enough to receive and restrain typical earphone wires from loosening during storage. The crest 24 has an important function of keeping the cable from slipping over the beak 10 and off the body during storage, which would cause the cable to become loose while in storage. A large fin 25 is included on the back of the body running largely between the crests 24. This fin 25 functions as a handle to hold while wrapping the cable around the wings. It also functions as a location to place logos for promotional activities. Company names, logos, slogans, etc. can be engraved, pad printed screen printed on the fin such that the device can be used as a promotional product.

Different sized channels to accommodate multiple wire dimensions may be used in the main channel running down the length of the body.

In the preferred embodiment, the signal end of the wire is seated in one of beaks located on either side of the device 10. The cantilever design serves two primary purposes: 1) to secure the wire to minimize the potential unwinding during storage (e.g., in pocket, purse); and 2) ultimate wire alignment to accommodate multiple wire features (e.g., microphone, earbuds). In the preferred embodiment of the integrated device, the wire is embedded within a central curved channel 12 that runs the length of the device. The central channel has a recessed sub-channel 14 that was included to accommodate multiple wire dimensions (e.g., differing wire radii). Located on the ends of the device on the backside of the beaks are recessed sections 16 to allow efficient transitioning of the wire from the first channel 12 of the device 100 to one of the hooks 18. Two sloped, filleted wings 18 are positioned on the lateral surface of the device perpendicular to the channel and are used to house the wrapped wires. The wings contain hooks 20 on their outer surfaces to secure the wire on the final wrap. Two additional protrusions 22 juxta positioned between the hooks and the lateral surface of the body of the device are included for subtle wire adjustments for optimal wire alignment to accommodate multiple wire dimensions. On the lateral surface of the device opposite to the hooks are two angled crests 24 that act to secure the wrapped wire and prevent slippage during storage.

As discussed above, the present invention is directed to a wire management device for flexible wire systems containing a signal terminal.

The current state of the headphone wire management includes both flexible systems (e.g., fabric-based) that remain attached to the headphone wires, and inflexible units (e.g., plastic) that separate from the headphone wires when unwound.

The present invention is a rigid, cylindrical device containing primary wings 18 and two hooks 20 and several small protrusions 10 and 24 of the same material and can be manufactured by a single step plastic-injection molding process.

Integral to the device is a central channel (first channel) 12 and a sub-channel (second channel) 14 in which the wire is embedded to create the integrated system. The sub-channel 14 is included to accommodate multiple wire dimensions. The wings 18 from the elongated frame 5 are designed for wrapping the headphone wire and securing the wires. For instance, the angle of each of the wings 18 is bent toward outer side from the central of the elongated frame 5 so that sufficient amount of turns of the headphone wire is performed with outer portions of the wings 18. The small protrusions 24 are incorporated for subtle wire adjustment and to secure the wrapped wires during storage. The device is ambidextrous by design.

According to some embodiments of the present invention, a wire storage device for storing a flexible wire on the device may include an elongated body having a groove channel substantially along a center line of the elongated frame having a carved channel to hold part of the wire, a first hook and a second hook, wherein each of the hooks can clamp part of the wire. Further, the wire storage device includes first and second beaks for securing the signal terminal of the wire.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

What is claimed is:

1. A wire management device for storing an earphone wire having a signal terminal and a pair of speakers, comprising:

an elongated frame having first and second ends, the frame having a first channel to hold a first wrapped part of the wire;

first and second beaks respectively arranged at the first and second ends of the frame to stay the terminal of the wire; and first and second wings respectively branching from neighboring positions of the first and second ends the frame, the first and second wings are, respectively, bent toward the first and second ends of the frame for wrapping the wire, wherein at least one of the wings includes a clamping portion to clamp a last wrapped part of the wire.

2. The wire management device of claim 1, wherein the first channel includes a second channel being narrower than the first channel at a bottom of the first channel to securely stay the end part of the wire.

3. The wire management device of claim 1, further comprising:

first and second protrusions respectively branching from near the first and second beaks to hook another part of the wire, wherein the first and second protrusions are disposed an opposite side of the first and second wings.

4. The wire management device of claim 1, wherein, each of the first and second wings includes a clamping portion to clamp an end part of the wire.

5. The wire management device of claim 4, wherein the clamping portion is formed by bending a part of each of the wings.

6. The wire management device of claim 1, wherein the first channel is arranged to be approximately along a centerline of the elongated frame.

7. The wire management device of claim 1, further comprises second hooks respectively branching from the first and second wings to gain adjustment of winding lengths for the wire.

8. The wire management device of claim 1, wherein each of the first and second beaks is formed to partly hold an end of the terminal.

9. The wire management device of claim 2, wherein a width of the second channel is between 0.8 mm and 1.2 mm.

10. The wire management device of claim 1, wherein the first channel includes a first width and a second width, wherein the first width is between 1.2 mm and 1.65 mm, and the second width is between 1.65 mm and 2.2 mm.

11. The wire management device of claim 1, further comprises a fin structure arranged between the first and second protrusions, wherein the fin structure is disposed to opposite the first and second wings.

12. The wire management device of claim 11, wherein the first channel includes a second channel being narrower than the first channel at a bottom of the first channel to securely stay the end part of the wire.

13. The wire management device of claim 11, further comprising:

first and second angled protrusions are respectively branched from near the first and second beaks to hook another part of the wire, wherein the first and second protrusions are disposed at an opposite side of the first and second wings.

14. The wire management device of claim 11, wherein, each of the first and second wings includes a clamping portion to clamp an end part of the wire.

15. The wire management device of claim 14, wherein the clamping portion is formed by bending a part of each of the wings.

16. The wire management device of claim 11, wherein the first channel is arranged to be approximately along a centerline of the elongated frame.

17. The wire management device of claim 11, further comprises second hooks respectively branching from the first and second wings to gain adjustment of winding lengths for the wire.

18. The wire management device of claim 11, wherein each of the beaks is formed to partly hold an end of the terminal.

19. The wire management device of claim 12, wherein a width of the second channel is between 0.8 mm and 1.2 mm.

20. The wire management device of claim 11, wherein the first channel includes a first width and a second width, wherein the first width is between 1.2 mm and 1.65 mm, and the second width is between 1.65 mm and 2.2 mm.

* * * * *